US007145090B2

(12) United States Patent
Shimizu

(10) Patent No.: US 7,145,090 B2
(45) Date of Patent: Dec. 5, 2006

(54) SWITCHING DEVICE

(75) Inventor: Keiichi Shimizu, Kasugai (JP)

(73) Assignee: Omron Corporation, Kyoto (JP)

( * ) Notice: Subject to any disclaimer, the term of this patent is extended or adjusted under 35 U.S.C. 154(b) by 58 days.

(21) Appl. No.: 11/351,016

(22) Filed: Feb. 9, 2006

(65) Prior Publication Data

US 2006/0175185 A1 Aug. 10, 2006

(30) Foreign Application Priority Data

Feb. 9, 2005 (JP) ..... 2005-033388

(51) Int. Cl.
*H01H 19/06* (2006.01)

(52) U.S. Cl. ..... 200/302.1; 200/302.3

(58) Field of Classification Search ..... 200/5 R, 200/1 B, 17 R, 18, 293, 302.1–302.3
See application file for complete search history.

(56) References Cited

U.S. PATENT DOCUMENTS 5,117,074 A * 5/1992 Yanai et al. ..... 200/302.3
5,647,478 A 7/1997 Hirai
5,824,981 A * 10/1998 Suzuki ..... 200/302.1
6,191,372 B1 * 2/2001 Sasaki et al. ..... 200/1 R
6,610,945 B1 * 8/2003 Onodera ..... 200/315
6,750,406 B1 * 6/2004 Komatsu et al. ..... 200/1 B
7,012,206 B1 * 3/2006 Oikawa ..... 200/302.1

FOREIGN PATENT DOCUMENTS

JP 5-314864 11/1993
JP 8-180755 7/1996
JP 11-86662 3/1999

OTHER PUBLICATIONS

Patent Abstracts of Japan, Publication No. 05-314864, Publication Date Nov. 26, 1993, 2 pages.
Patent Abstracts of Japan, Publication No. 11-086662, Publication Date Mar. 30, 1999, 2 pages.

* cited by examiner

*Primary Examiner*—Michael A. Friedhofer
(74) *Attorney, Agent, or Firm*—Osha Liang L.L.P.

(57) ABSTRACT

A switching device includes a switch, a case within which the switch is accommodated, a cylindrical hollow section which is disposed on the upper surface of the case and has upper and lower openings to communicate with the inside of the case, an operation knob provided to cover the upper opening of the cylindrical section such that the operation knob can swing, and an operation bar penetrating through the lower opening of the cylindrical section and extending to the inside of the case so as to transmit the motion of the operation knob to the switch. A projection for preventing water from entering into the case is provided on the outside surface of the cylindrical section opposed to the inside surface of the operation knob.

6 Claims, 13 Drawing Sheets

SWITCHING DEVICE

BACKGROUND OF THE INVENTION

1. Technical Field

The present invention relates to a switching device for switching on and off by the operation of a swingable operation knob, and more particularly to a waterproof-type switching device which is capable of preventing water from entering into its case.

2. Description of the Related Art

FIG. 10 illustrates an external appearance of a switching device 100 as an example used in a vehicle window opening and closing system (power window system). The switching device 100 includes a case 1 which is constituted by an upper case 1*a* and a lower case 1*b*. While a part of the lower case 1*b* is shown in FIG. 10, the lower case 1*b* actually engages with the lower portion of the upper case 1*a* as illustrated in the cross-sectional view of FIG. 13. A plurality of projections 1*c* are formed on the lower case 1*b*, and a plurality of holes 1*d* are formed on the upper case 1*a*, as illustrated in FIG. 10. For assembling the case 1, the projections 1*c* are brought into engagement with the holes 1*d* so as to fix the upper case 1*a* and the lower case 1*b* to each other.

Components such as a switch and a circuit board which will be described later are accommodated within the case 1. Attachments 2 for attaching a cover which will be described later are formed on the upper region of the case 1. A connector 3 is connected with a connection cable used for connection with a controller (not shown). An operation knob 4 of a door lock switch is operated for locking the respective doors of the vehicle such that they cannot be opened, or for releasing the lock. An operation knob 5 of a window lock switch is operated for locking the respective windows of the vehicle such that they cannot be opened or closed, or for releasing the lock. Four operation knobs 6 of a window opening and closing switch are operated for opening and closing the respective windows of the vehicle. The operation knob 4 and the operation knobs 6 are seesaw-motion type knobs capable of swinging like a seesaw, and the operation knob 5 is a knob formed by a lock-type push button. The operation knob 6 includes operation sections 6*a*, cap sections 6*b* formed integrally with the operation sections 6*a*, and holes 6*c* formed on the side walls of the cap sections 6*b*. While one hole 6*c* on each operation knob 6 is shown in FIG. 10, the same hole as the hole 6*c* is formed on the side wall opposite to the side wall where the hole 6*c* is provided.

FIG. 11 illustrates an external appearance of the case 1 shown in FIG. 10 from which the four operation knobs 6 are removed. In the figure, cylindrical sections 7 provided on an upper surface 1*e* of the case 1, shaft members 7*a* formed integrally with the outer walls of the respective cylindrical sections 7, and upper openings 7*b* of the cylindrical sections 7 which open to above are shown. While one shaft member 7*a* on each cylindrical section 7 is illustrated in FIG. 11, the same shaft member as the shaft member 7*a* is formed integrally with the outer wall opposite to the outer wall where the shaft member 7*a* is provided. By attaching the cap sections 6*b* of the operation knobs 6 to the cylindrical sections 7 from above such that the cap sections 6*b* can cover the upper openings 7*b*, and engaging the shaft members 7*a* of the cylindrical sections 7 with the holes 6*c* of the operation knobs 6, the case 1 is brought to the condition shown in FIG. 10 and the operation knobs 6 are supported by the cylindrical sections 7 such that the operation knobs 6 can swing around the shaft members 7*a*.

FIG. 12 illustrates an external appearance of the switching device 100 shown in FIG. 10 to which a cover 8 is attached. The cover 8 covers the switching device 100 in the area other than the operation knobs 4 through 6 when the switching device 100 is attached to an arm rest (not shown) provided on the door of the driver's seat of the vehicle. The cover 8 has bosses 9, and the cover 8 is attached to the switching device 100 by fitting screws (not shown) inserted from the back of attachments 2 of the case 1 to screw holes (not shown) formed on the bosses 9. Four openings 8*a* through which the fingers are inserted to operate the operation sections 6*a* of the respective operation knobs 6 are formed on the cover 8, and the operation sections 6*a* are exposed through the openings 8*a*. Openings 8*c* and 8*d* through which the operation knob 4 and the operation knob 5 are exposed, respectively, are also formed. The opening areas of the openings 8*c* and 8*d* are small since the operation knobs 4 and 5 are only pushed from above for operation. However, the opening areas of the openings 8*a* are large since the operation knobs 6 need to be lowered and raised with the fingers being putted on the operation section 6*a*.

FIG. 13 is a cross-sectional view of the switching device 100 to which the cover 8 is attached. As apparent from the figure, the cylindrical sections 7 are cylindrical hollow components which open to above and below and communicate with the inside of the case 1. A circuit board 10 is equipped within the case 1, and switches 11 are mounted on the circuit board 10. The switches 11 are switches for opening and closing the windows, and are constituted by known slide switches. Actuators 11*a* for the switches 11 are provided. Operation bars 12 connected with the operation knobs 6 penetrate through lower openings 7*c* of the cylindrical sections 7 and extend to the inside of the case 1. Concaves 12*a* are formed at the lower ends of the operation bars 12. Through the engagement between the concaves 12*a* and the actuators 11*a* of the switches 11, the motions of the operation knobs 6 are transmitted through the operation bars 12 to the switches 11 such that contacts provided inside the switches 11 can be switched on and off in accordance with the operation positions of the operation knobs 6.

Switching devices having a structure similar to that of the above switching device 100 are disclosed in JP-A-8-180755 and JP-A-5-314864. JP-A-11-86662 shows a similar switching device which is waterproofed by surrounding soldered portions of electronic component terminals on a circuit board with side walls formed by rubber contact members without requiring coatings.

In the known switching device 100 shown in FIG. 12, however, there is a possibility that raindrops coming through the windows left opened or beverages accidentally spilled inside the vehicle enter through the openings 8*a* into concaves 8*b* (see FIG. 13), since the opening areas of the openings 8*a* of the cover 8 are large. Since the volumes of the concaves 8*b* are considerably large such that the operation by the fingers can be carried out without trouble, the entering water passes through clearances 13 between the cover 8 and the operation knobs 6 and clearances 14 between the operation knobs 6 and the cylindrical sections 7 as shown by an arrow in FIG. 13 when the amount of the water flown into the concaves 8*b* is large. The water then enters from the upper openings 7*b* of the cylindrical sections 7 into the cylindrical sections 7, passes through the lower openings 7*c* of the cylindrical sections 7, and reaches the inside of the case 1. No description about waterproofing of water entering through the lower portions of the operation knobs 6 is made in either JP-A-8-180755 or JP-A-5-314864. Also, while JP-A-11-86662 discloses the waterproofing technique for preventing short-circuit, entering of water through the lower portions of the operation knobs into the inside of the case cannot be prevented in such a switching device which does not employ rubber contacts according to the technique shown in this reference.

SUMMARY OF THE INVENTION

Accordingly, it is an object of the invention to provide a switching device capable of preventing water from entering from the outside of a case through the lower portions of operation knobs into the inside of the case.

A switching device according to the invention includes a switch, a case within which the switch is accommodated, a cylindrical hollow section which is disposed on the upper surface of the case and has upper and lower openings to communicate with the inside of the case, an operation knob provided to cover the upper opening of the cylindrical section such that the operation knob can swing, and an operation bar penetrating through the lower opening of the cylindrical section and extending to the inside of the case so as to transmit the motion of the operation knob to the switch. A projection for preventing water from entering into the case is provided on the outside surface of the cylindrical section opposed to the inside surface of the operation knob.

Since the projection is provided, water coming from the outside of the case through a clearance between the operation knob and the cylindrical section is blocked by the projection and therefore prevented from entering through the upper opening of the cylindrical section into the case.

In the structure according to the invention, the operation knob is supported by the cylindrical section such that the operation knob can swing, and among the outside surface of the cylindrical section, the projection is provided on the outside surface of the cylindrical section on the side to and from which the inside surface of the operation knob shifts close and away in accordance with the swinging motion of the operation knob. For allowing the operation knob to be supported by the cylindrical section such that the operation knob can swing, a clearance for assuring the swinging motion of the operation knob between the inside surface of the operation knob and the outside surface of the cylindrical section is required, and thus water can easily enter from the lower portion of the operation knob into the cylindrical section through this clearance. By providing the projection on the outside surface of the cylindrical section to and from which the inside surface of the operation knob shifts close and away as in the above structure, the flow of water entering through the lower portion of the operation knob can be effectively blocked.

In this case, it is preferable to dispose the projection at the upper end of the outside surface. When the operation knob is supported by the cylindrical section such that the operation knob can swing, the distance between the inside surface of the operation knob and the outside surface of the cylindrical section when the inside surface of the operation knob comes close to the outside surface of the cylindrical section in accordance with the swinging motion decreases at the lower position of the cylindrical section. Since the projection is provided at the upper end of the outside surface of the cylindrical section, the projection length of the projection is the largest. Accordingly, entering of water can be more effectively prevented.

The projection provided according to the invention may be formed on both sides of the outside surface of the cylindrical section with the upper opening of the cylindrical section interposed between both sides of the outside surface. In this case, water coming from both sides of the lower portion of the operation knob can be prevented from entering into the case.

In the structure according to the invention, a plurality of vertically extending grooves may be formed in lieu of the above projections. In this case, water coming from the outside of the case disperses to the plural grooves, and a small amount of the dispersed water is collected within the respective grooves. The collected water is retained in the grooves due to its surface tension, and functions as a wall for preventing water coming next from entering therethrough. Thus, the water coming next is prevented from entering through the upper openings of the cylindrical section into the case.

In the structure according to the invention, a projection for preventing water from entering into the case may be provided on the inside surface of the operation knob opposed to the outside surface of the cylindrical section. In this case, flow of water entering from the outside of the case through the clearance between the operation knob and the cylindrical section is also blocked by the projection. Thus, water is prevented from entering through the upper opening of the cylindrical section into the case.

Therefore, in the structure according to the invention, water entering from the outside of the case through the lower portion of the operation knob into the case can be blocked by the projections and grooves, and thus the switching device can be effectively waterproofed.

DESCRIPTION OF THE PREFERRED EMBODIMENTS

Figure 10:
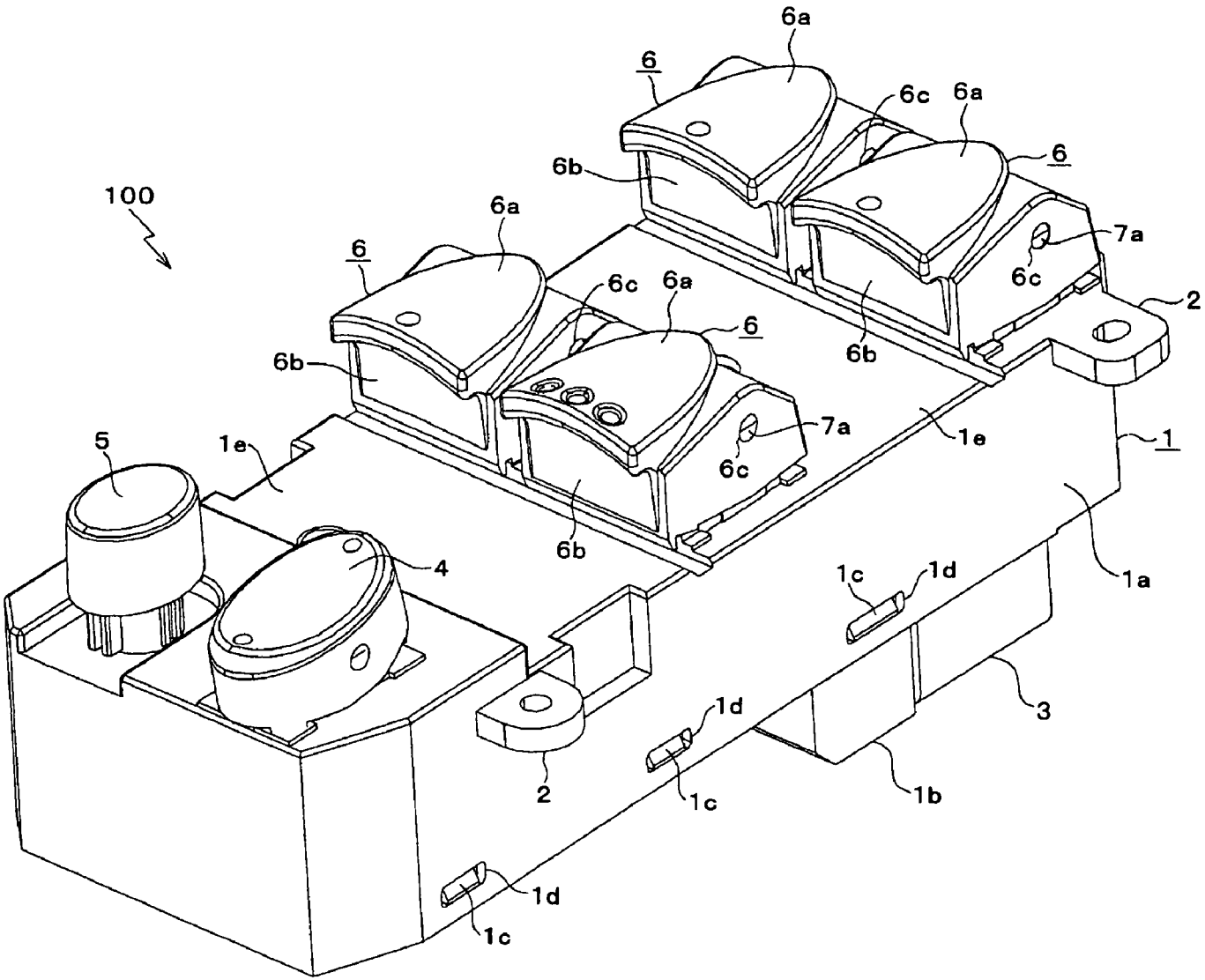
FIG. 10 illustrates an external appearance of an example of a switching device.
Figure 12:
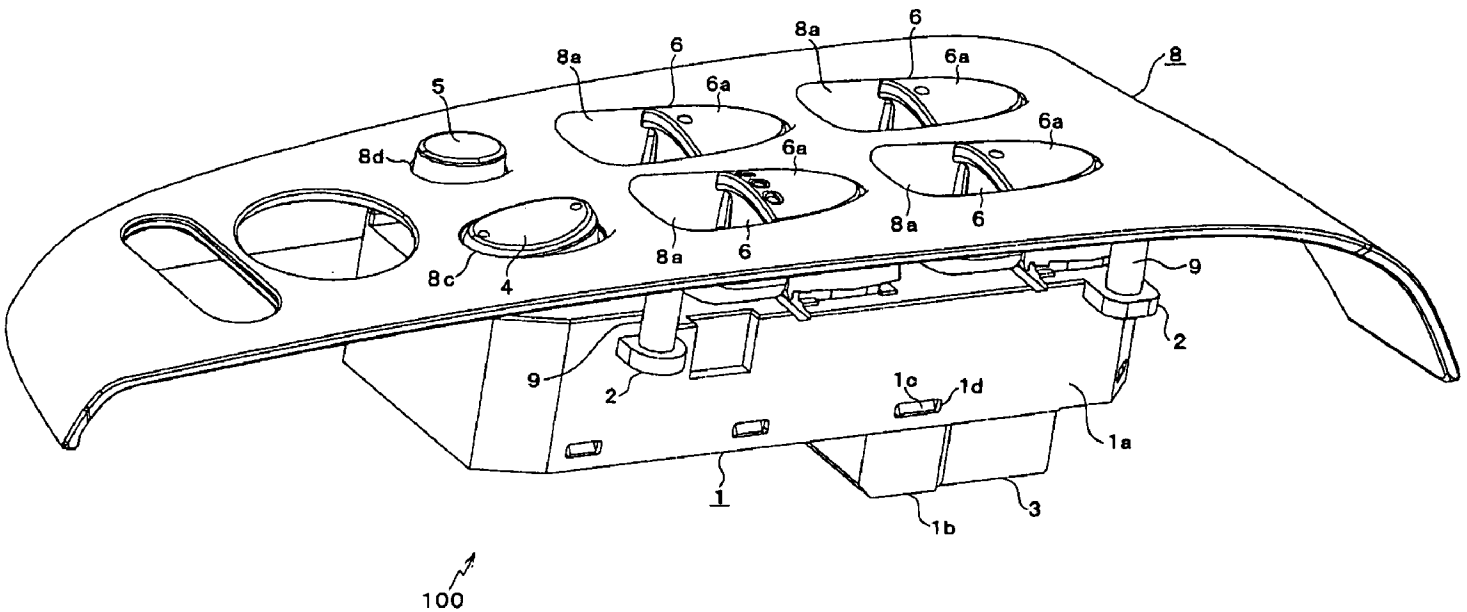
FIG. 12 illustrates an external appearance of the switching device to which a cover is attached.

Several embodiments according to the invention are hereinafter described with reference to FIGS. 1 through 7. In these figures, like reference numerals are given to like components. Since the external appearance of the switching device 100 described in the following respective embodiments is similar to that shown in FIG. 10 and the condition where the cover 8 is attached to the switching device 100 is similar to that shown in FIG. 12, FIGS. 10 and 12 are also referred to in the description of the embodiments according to the invention.

Figure 1:
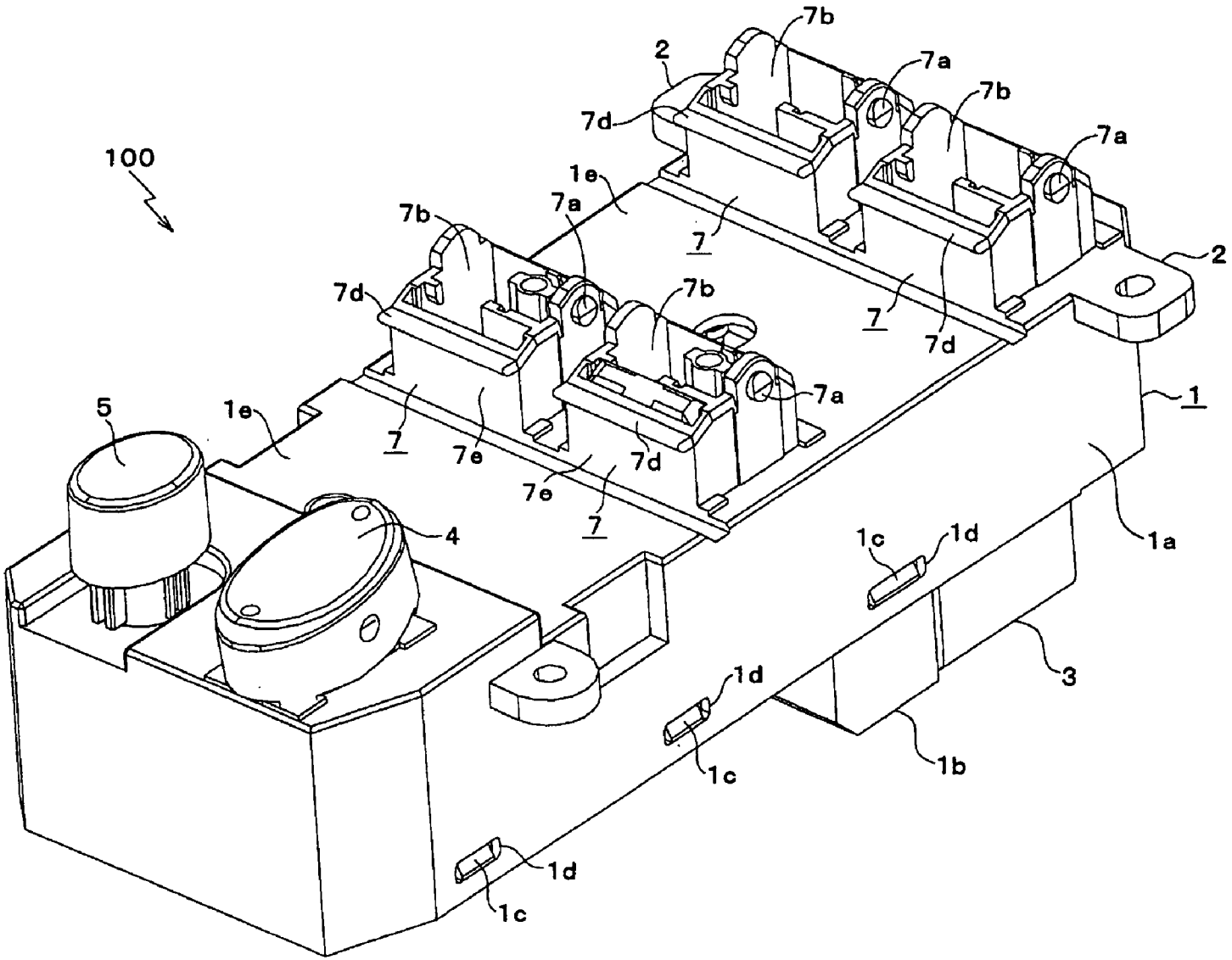
FIG. 1 illustrates an external appearance of a switching device from which operation knobs are removed in a first embodiment according to the invention.
Figure 2:
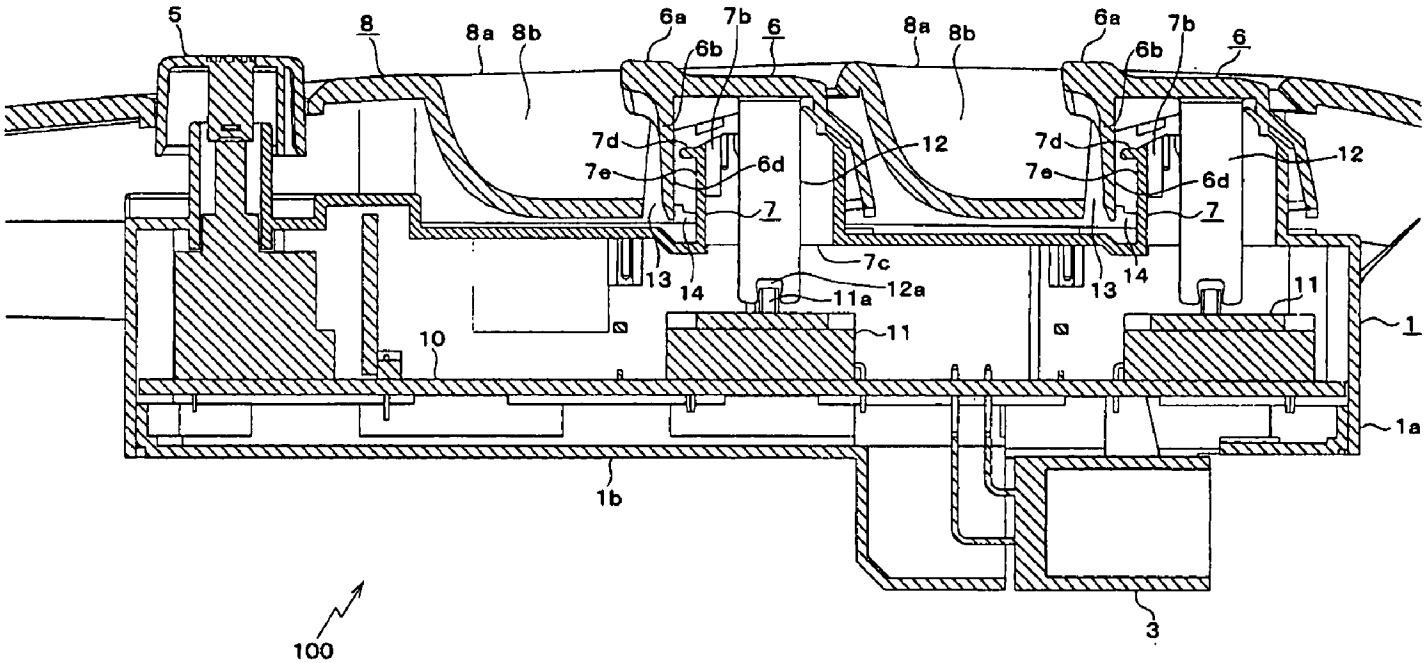
FIG. 2 is a cross-sectional view of the switching device to which a cover is attached.
Figure 3:
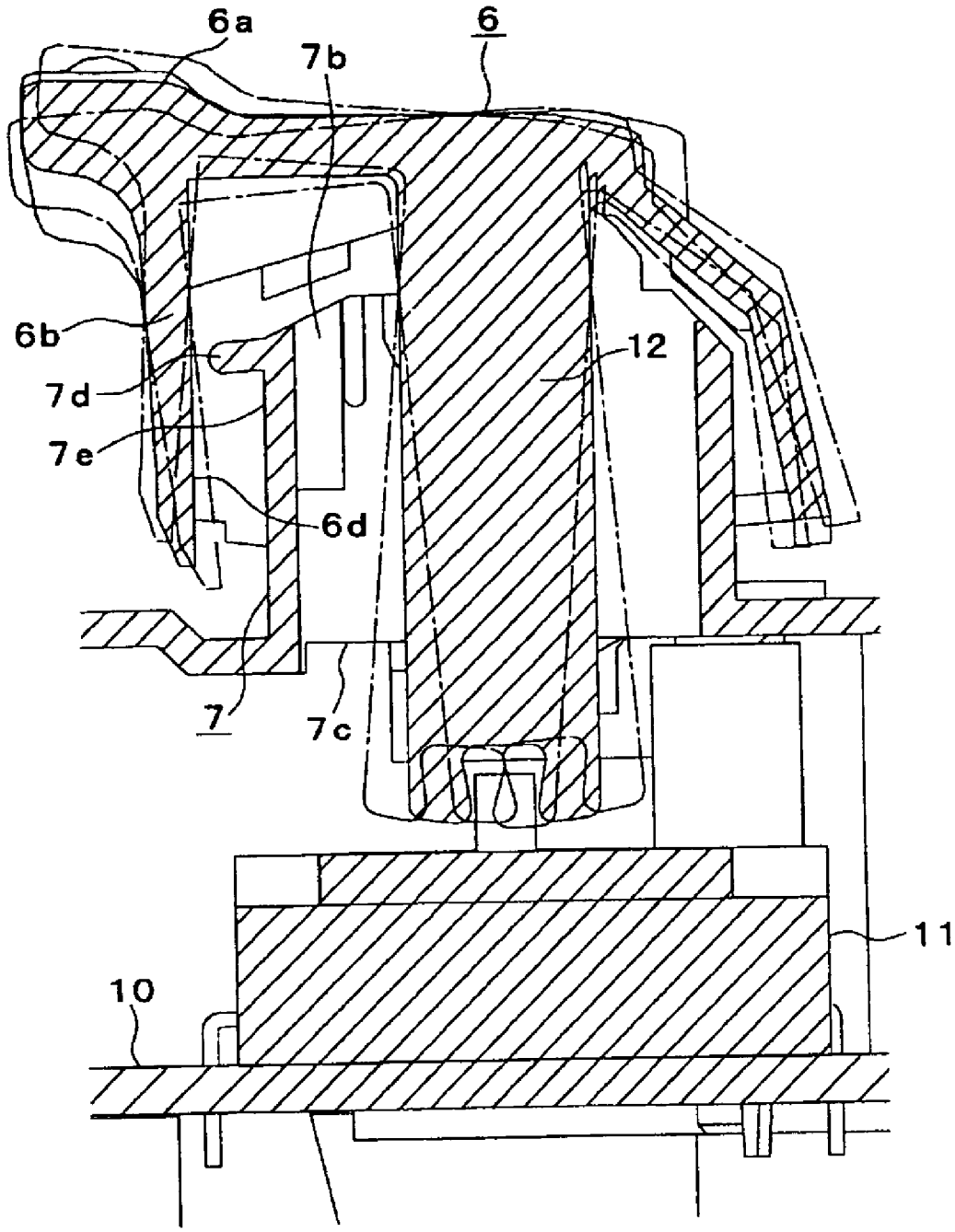
FIG. 3 is a cross-sectional view illustrating a main part of the switching device.
Figure 11:
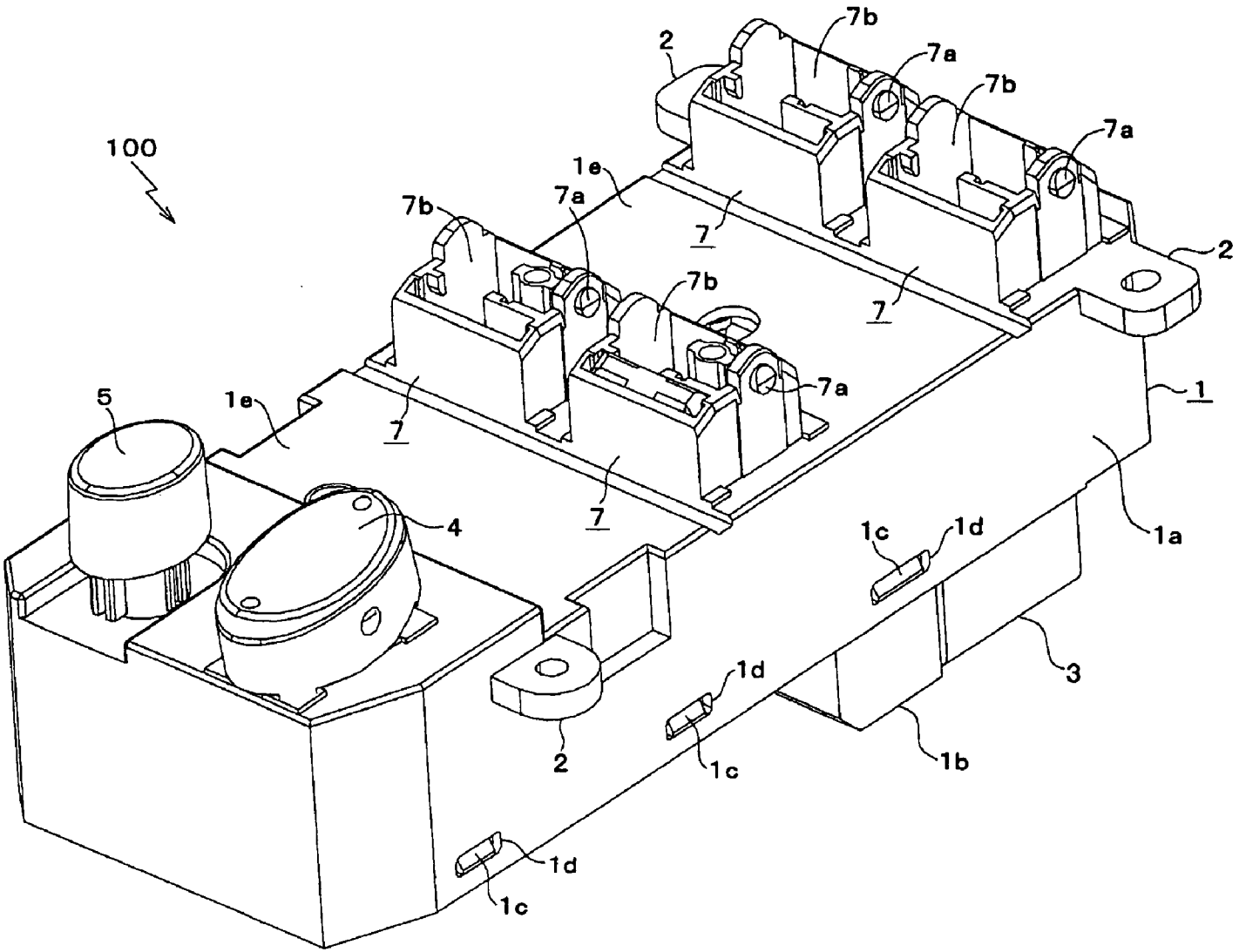
FIG. 11 illustrates an external appearance of the switching device shown in FIG. 10 from which operation knobs are removed.

FIGS. 1 through 3 illustrate the switching device 100 in a first embodiment. FIG. 1 shows an external appearance of the switching device 100 shown in FIG. 10 from which the four operation knobs 6 are removed. The switching device 100 includes the cylindrical sections 7 provided on the upper surface 1*e* of the case 1, the shaft members 7*a* formed integrally with the outer walls of the respective cylindrical sections 7, and the upper openings 7*b* of the cylindrical sections 7 which open to above. The horizontal cross-section of the cylindrical sections 7 is substantially rectangular in this embodiment, but may have other shapes such as a circular shape. While one shaft member 7*a* on each cylindrical section 7 is illustrated in FIG. 1, the same shaft member as the shaft member 7*a* is formed integrally with the outer wall opposite to the outer wall where the shaft member 7*a* is provided. By attaching the cap sections 6*b* of the operation knobs 6 to the cylindrical sections 7 from above such that the cap sections 6*b* can cover the upper openings 7*b* and engaging the shaft members 7*a* of the cylindrical sections 7 with the holes 6*c* of the operation knobs 6, the case 1 is brought to the condition shown in FIG. 10, and the operation knobs 6 are supported by the cylindrical sections 7 such that the operation knobs 6 can swing around the shaft members 7*a*. This structure is the same as that of the switching device 100 in FIG. 11. However, the switching device 100 shown in FIG. 1 is different from that shown in FIG. 11 in that projections 7*d* are provided on outside surfaces 7*e* of the respective cylindrical members 7. The respective projections 7*d* formed integrally with the cylindrical sections 7 have substantially the same width as that of the outside surfaces 7*e* of the cylindrical sections 7 and extend in a direction substantially parallel to the direction of the upper surface 1*e* of the case 1.

Figure 13:
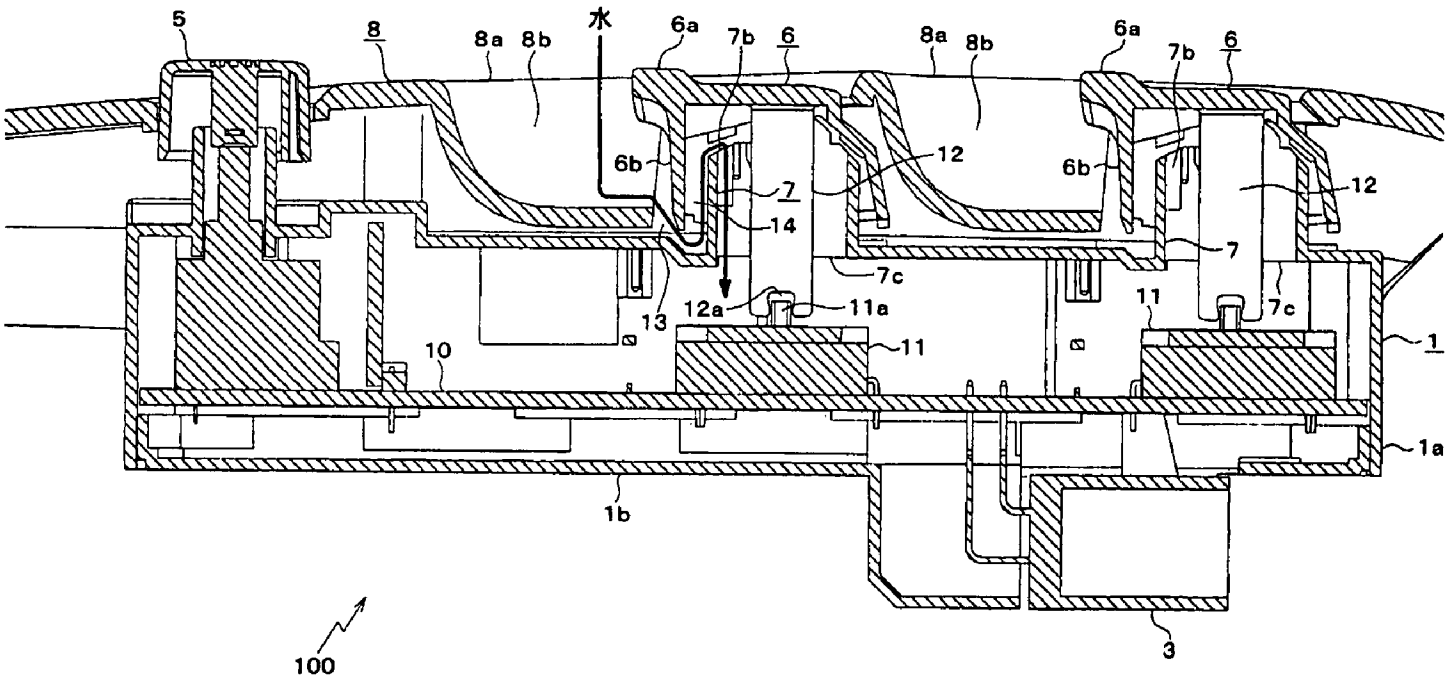
FIG. 13 is a cross-sectional view of the switching device to which the cover is attached.

FIG. 2 is a cross-sectional view of the switching device 100 to which the cover 8 is attached. As apparent from the figure, the cylindrical sections 7 are hollow cylindrical components which open to above and below and communicate with the inside of the case 1. A circuit board 10 is equipped inside the case 1, and switches 11 are mounted on the circuit board 10. The switches 11 are switches for opening and closing the windows, and are constituted by known slide switches. Actuators 11*a* for the switches 11 are provided. Operation bars 12 connected with the operation knobs 6 penetrate through the lower openings 7*c* of the cylindrical sections 7 and extend to the inside of the case 1. Concaves 12*a* are formed at the lower ends of the operation bars 12. Through the engagement between the concaves 12*a* and the actuators 11*a* of the switches 11, the motions of the operation knobs 6 are transmitted through the operation bars 12 to the switches 11 such that contacts provided inside the switches 11 are switched on and off in accordance with the operation positions of the operation knobs 6. This structure is the same as that of the switching device 100 shown in FIG. 13.

As illustrated in FIG. 2, the projections 7*d* are disposed on the outside surfaces 7*e* of the cylindrical sections 7 at positions opposed to inside surfaces 6*d* of the cap sections 6*b* of the operation knobs 6. Since the clearances 14 between the inside surfaces 6*d* of the operation knobs 6 and the outside surfaces 7*e* of the cylindrical sections 7 are required so that the operation knobs 6 can sufficiently swing, water entering through the openings 8*a* into the concaves 8*b* of the cover 8 flows from the lower portions of the operation knobs 6 through the clearances 13 between the cover 8 and the operation knobs 6 into the clearances 14, and then enters through the upper openings 7*b* of the cylindrical sections 7 into the inside of the cylindrical sections 7 if the projections 7*d* are not provided. In this embodiment, however, the projections 7*d* project in the upper regions of the clearances 14 and block the flow of water entering from the clearances 14 into the upper openings 7*b*. Thus, water entered form below the operation knob 6 is prevented from entering from the upper openings 7*b* of the cylindrical sections 7 through the lower openings 7*c* into the case 1.

The projections 7*d* may be disposed at arbitrary positions on the outside surfaces 7*e* of the cylindrical sections 7. In this embodiment, the projections 7*d* are located at the upper ends of the outside surfaces 7*e*. Since the operation knobs 6 are supported by the shaft members 7*a* of the cylindrical sections 7 such that the operation knobs 6 can swing, the inside surfaces 6*d* of the operation knobs 6 shift close to and away from the outside surfaces 7*e* in accordance with the swinging motion of the operation knobs 6 as shown by an alternate long and short dash line in FIG. 3. The distance between the inside surfaces 6*d* and the outside surfaces 7*e* when the inside surfaces 6*d* come close to the outside surfaces 7*e* decreases at the lower position of the cylindrical sections 7 and increases at the upper position of the cylindrical sections 7. Since the projections 7*d* are disposed at the upper ends of the outside surfaces 7*e*, the projection length of the projections 7*d* is the largest. Accordingly, entering of water can be more effectively prevented.

Figure 4:
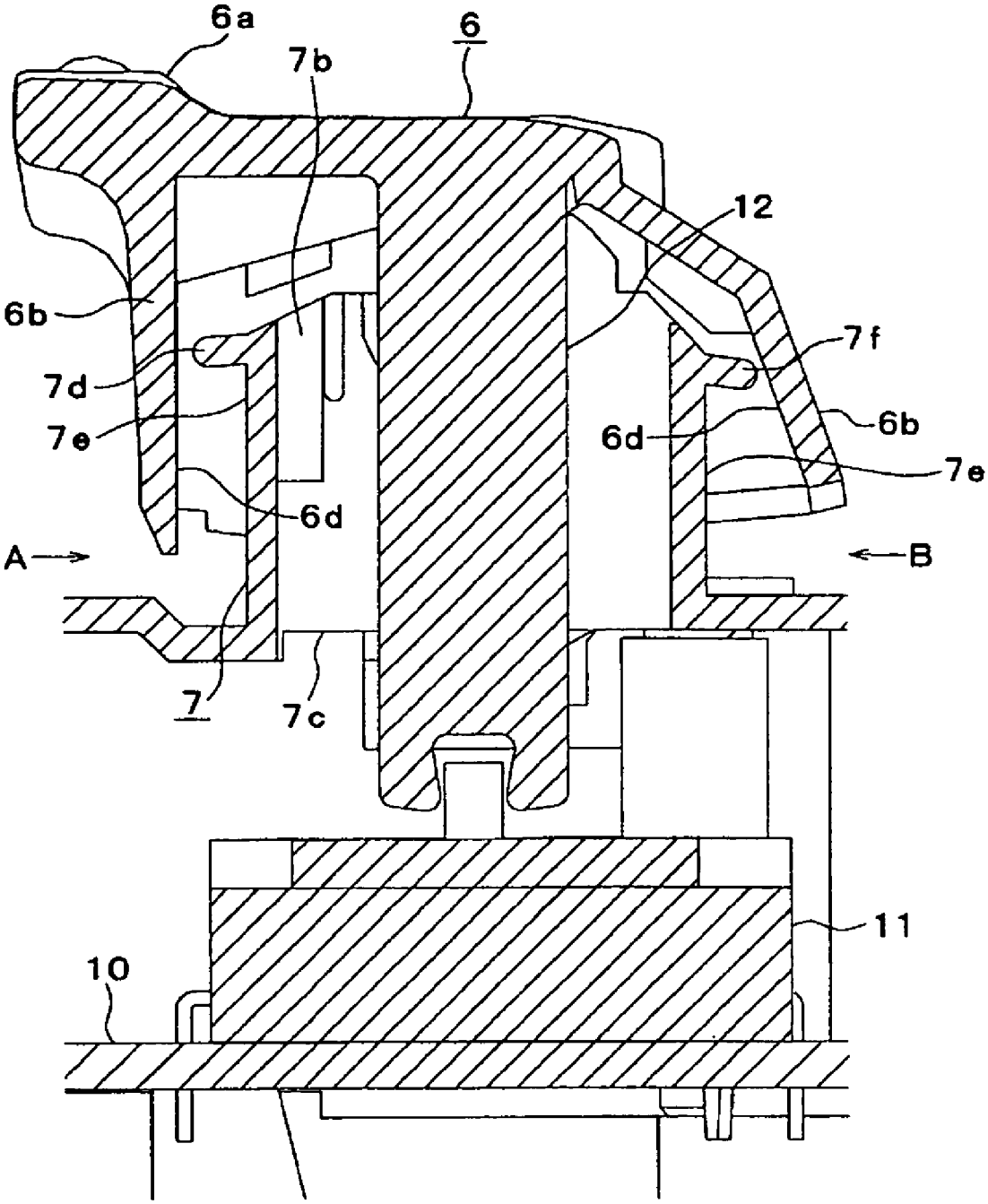
FIG. 4 is a cross-sectional view illustrating a main part of a switching device in a second embodiment according to the invention.

FIG. 4 is a cross-sectional view illustrating a main part of the switching device in a second embodiment according to the invention. The entire structure of the switching device is basically the same as that of the switching device shown in FIGS. 1 through 3. In the second embodiment, projections 7*f* are further provided as well as the projections 7*d* shown in the first embodiment. More specifically, the projection 7*d* is disposed on one side and the projection 7*f* is disposed on the other side of the outside surface 7*e* of each cylindrical section 7 with the upper opening 7*b* of the cylindrical section 7 interposed between both sides of the outside surface 7*e*. While the projections 7*f* are disposed at the upper ends of the outside surfaces 7*e* similarly to the projections 7*d*, the positions of the projections 7*f* may be arbitrarily determined. According to the embodiment, water is prevented from entering through both sides of the lower portion of each operation knob 6 (directions indicated by arrows A and B) into the case 1.

Figure 5:
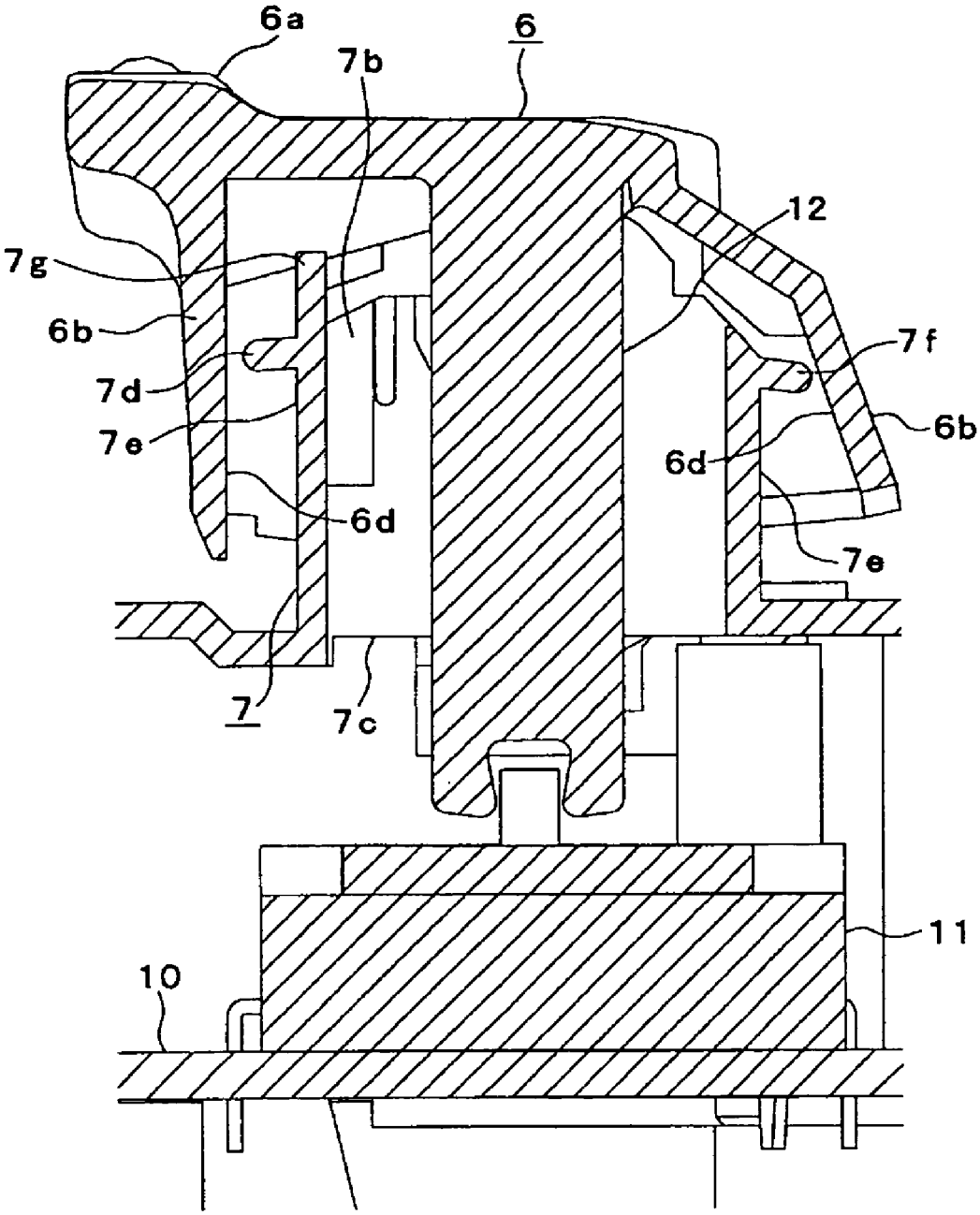
FIG. 5 is a cross-sectional view illustrating a main part of a switching device in a third embodiment according to the invention.

FIG. 5 is a cross-sectional view illustrating a main part of a switching device in a third embodiment according to the invention. The entire structure of the switching device is basically the same as that of the switching device shown in FIGS. 1 through 3. In the third embodiment, projections 7*g* are further provided to the cylindrical sections 7 as well as the projections 7*d* and 7*f* shown in the second embodiment. The projections 7*g*, which are provided at the upper ends of the outside surfaces 7*e* where the projections 7*d* are formed, extend upward in a direction substantially perpendicular to the projections 7*d*. The projections 7*g* have substantially the same width as that of the projections 7*d* shown in FIG. 1 and extend in a direction approximately parallel to the upper surface 1*e* of the case 1. In this embodiment, even when water enters from the lower portions of the operation knobs 6 through the projections 7*d*, the water is prevented from further entering through the upper openings 7*b* of the cylindrical sections 7 by the projections 7*g* extending upward. Thus, waterproofing effect is further enhanced. If necessary, projections similar to the projections 7*g* may be provided at the upper ends of the outside surfaces 7*e* on the side where the projections 7*f* are formed. In FIG. 5, the projections 7*g* are added to the structure shown in FIG. 4, but the projections 7*g* may be added to the structure shown in FIG. 3.

Figure 6:
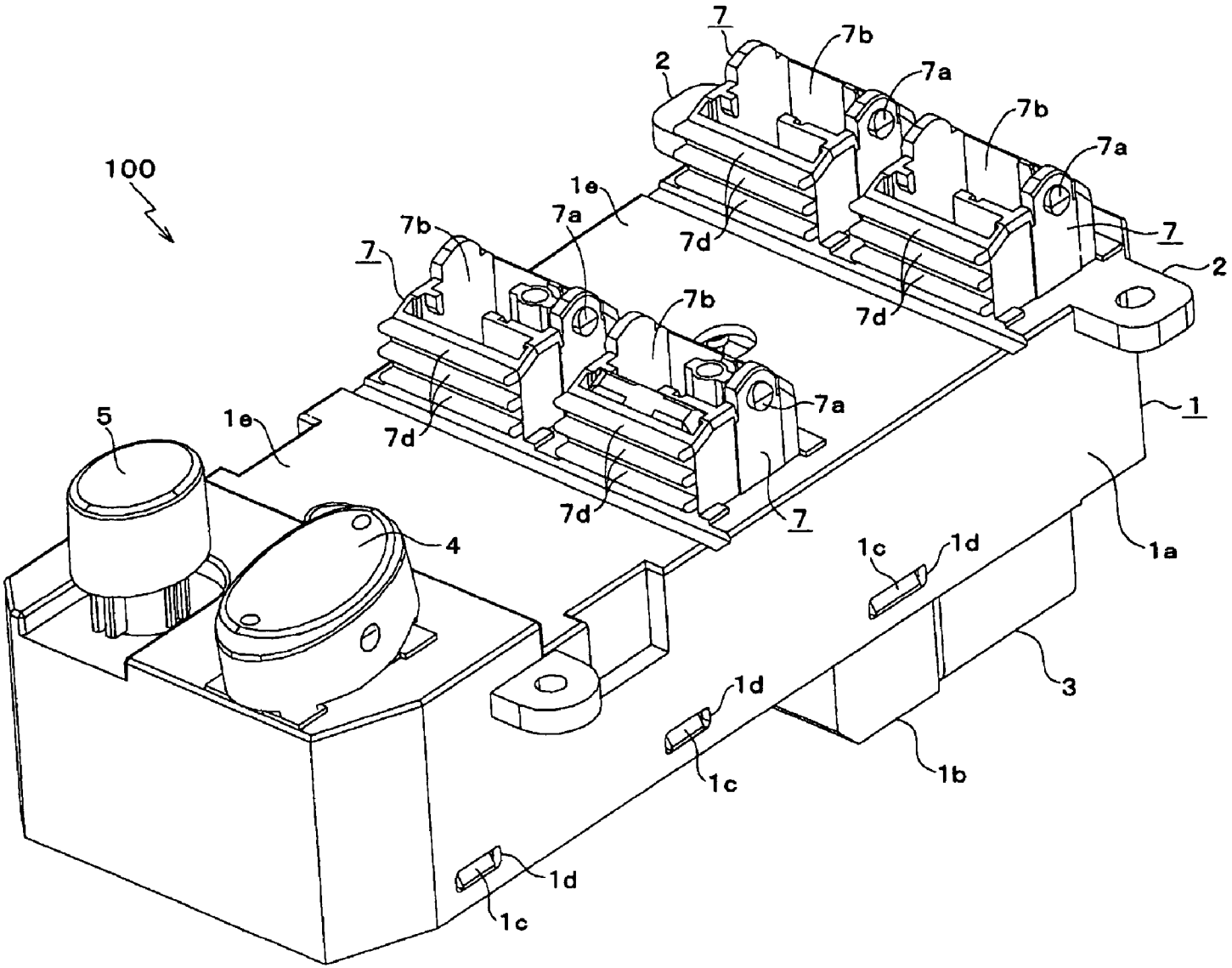
FIG. 6 illustrates an external view of a switching device from which operation knobs are removed in a fourth embodiment according to the invention.

FIG. 6 illustrates an external appearance of a switching device from which the operation knobs 6 are removed in a fourth embodiment according to the invention. In the fourth embodiment, a plurality of rows of the projections 7*d* shown in the first embodiment are equipped on the respective cylindrical sections 7. While three rows of the projections 7*d* are formed on the outside surface of each cylindrical section 7 in this embodiment, the number of the projections 7*d* may be arbitrarily determined. Since the plural projections 7*d* are provided in the water flow direction in this embodiment, water coming from the lower portions of the operation knobs 6 is further prevented from entering through the upper openings 7*b* of the cylindrical sections 7 into the case 1 compared with the structure where the single projection 7*d* is equipped on each cylindrical section 7. Thus, waterproofing effect is further enhanced. If necessary, the plural projections 7*d* may be provided on both sides of the outside surface of each cylindrical section 7 with the upper opening 7*b* interposed between both sides of the outside surface. Additionally, the projections 7*g* extending upward shown in FIG. 5 may be provided at the upper ends of the outside surfaces of the cylindrical sections 7 as well as the plural projections 7*d*.

Figure 7:
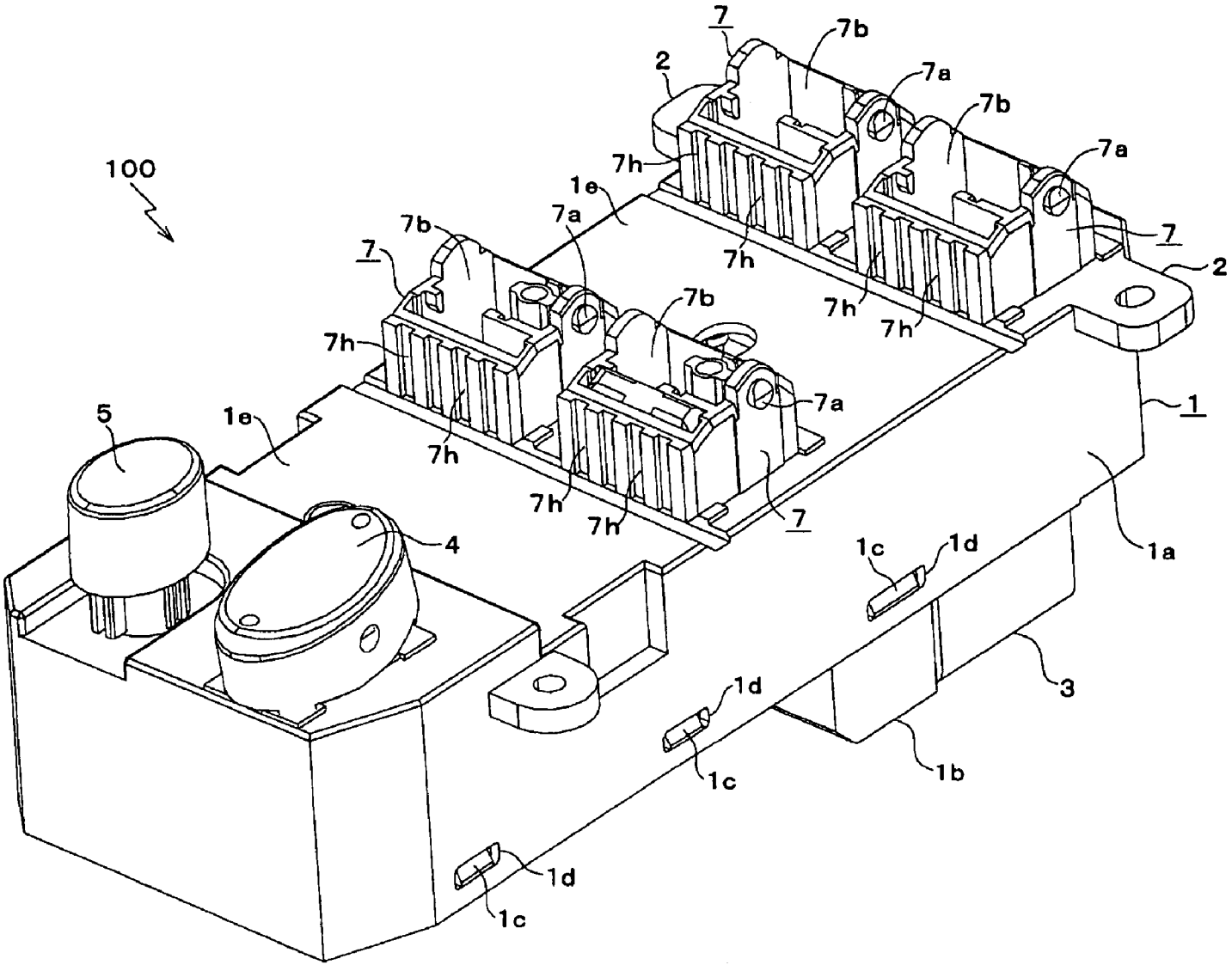
FIG. 7 illustrates an external view of a switching device from which operation knobs are removed in a fifth embodiment according to the invention.

FIG. 7 illustrates an external appearance of a switching device from which the operation knobs 6 are removed in a fifth embodiment according to the invention. In the fifth embodiment, a plurality of grooves 7*h* are formed in each cylindrical section 7 instead of the projections 7*d* shown in the first and fourth embodiments. The grooves 7*h* vertically extend on the outside surfaces of the cylindrical sections 7 opposed to the inside surfaces of the operation knobs 6. While the four grooves 7*h* are formed on each cylindrical section 7 in this embodiment, the number of the grooves 7*h* may be arbitrarily determined. In this embodiment, water coming from the lower portions of the operation knobs 6 disperses to the plural grooves 7*h*, and a small amount of the dispersed water is collected within the respective grooves 7*h*. The collected water is retained in the grooves 7*h* due to its surface tension, and functions as a wall for preventing water coming next from entering therethrough. Thus, in the grooves 7*h*, the water coming next is prevented from entering through the upper openings 7*b* of the cylindrical sections 7 into the case 1. If necessary, the plural grooves 7*h* may be formed on both sides of the outside surface of each cylindrical section 7 with the upper opening 7*b* interposed between both sides of the outside surface. Additionally, the projection 7*g* extending upward shown in FIG. 5 may be provided at the upper ends of the outside surfaces of the cylindrical sections 7 as well as the plural grooves 7*h*.

Figure 8:
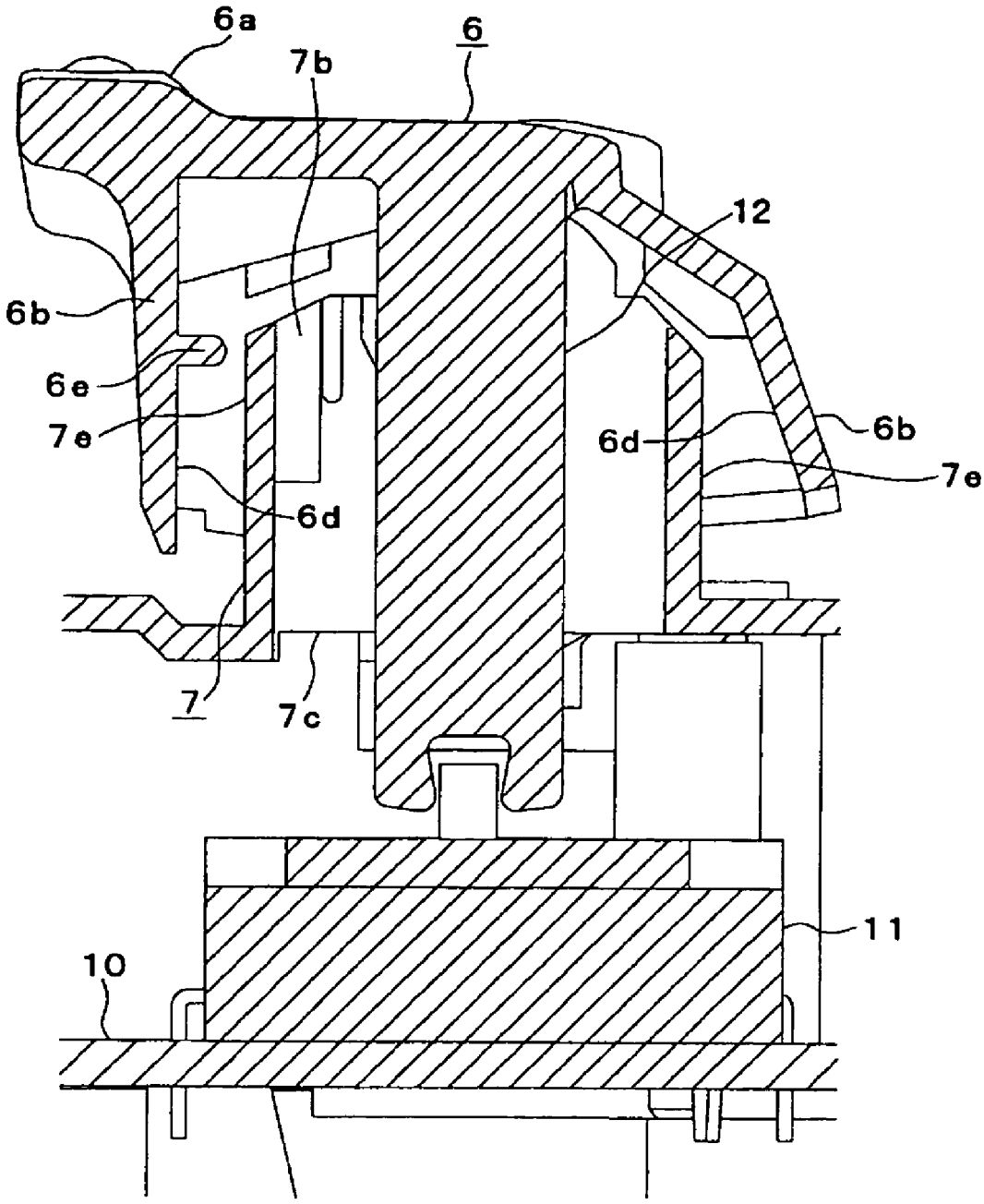
FIG. 8 is a cross-sectional view illustrating a main part of a switching device in a sixth embodiment according to the invention.

FIG. 8 is a cross-sectional view illustrating a main part of a switching device in a sixth embodiment according to the invention. The entire structure of the switching device is basically the same as that of the switching device shown in FIGS. 1 through 3. In the sixth embodiment, projections for preventing water from entering into the case are provided on the operation knobs. More specifically, projections 6*e* are provided on the inside surfaces 6*d* of the operation knobs 6 opposed to the outside surfaces 7*e* of the cylindrical sections 7. The projections 6*e* are formed integrally with the operation knobs 6. The projections 6*e* have substantially the same width as that of the outside surfaces 7*e* of the cylindrical sections 7 similarly to the projections 7*d* shown in FIG. 1, and extend in a direction approximately parallel to the upper surface 1*e* of the case 1. While the projections 6*e* are disposed at positions corresponding to the upper ends of the outside surfaces 7*e* of the cylindrical sections 7 in this embodiment, the positions of the projections 6*e* may be arbitrarily determined. In this embodiment, water coming from the lower portions of the operation knobs 6 is also prevented from entering into the case 1.

Figure 9:
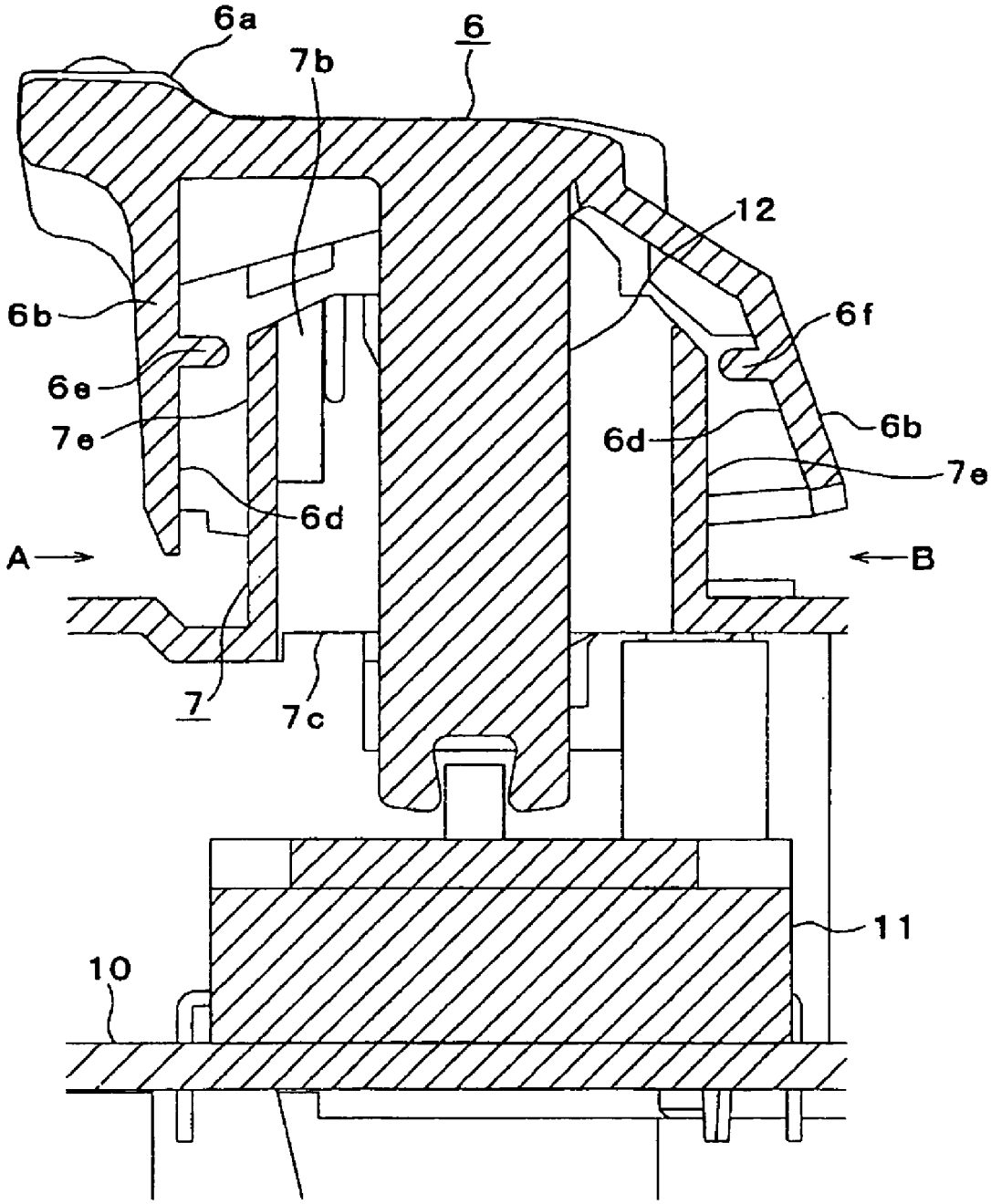
FIG. 9 is a cross-sectional view illustrating a main part of a switching device in a seventh embodiment according to the invention.

FIG. 9 is a cross-sectional view illustrating a main part of a switching device in a seventh embodiment according to the invention. The entire structure of the switching device is basically the same as that of the switching device shown in FIGS. 1 through 3. In the seventh embodiment, projections 6*f* are further provided on the operation knobs as well as the projections 6*e* in the sixth embodiment shown in FIG. 8. More specifically, the projection 6*e* and 6*f* are formed on the inside surface 6*d* of each operation knob 6 opposed to both sides of the outside surface 7*e* of each cylindrical sections 7 with the upper opening 7*b* of the cylindrical section 7 interposed between both sides of the outside surface 7*e*. In this embodiment, water coming from both sides of the lower portion of each operation knob 6 as indicated by arrows A and B is prevented from entering into the case 1.

Accordingly, as discussed in the respective embodiments, water is prevented from entering through the lower portions of the operation knobs 6 into the case 1 by the projections 6*e*, 6*f*, 7*d*, 7*f* and 7*g* and the grooves 7*h* even when raindrops coming through the windows and spilled beverages flow through the openings 8*a* of the cover 8 into the concaves 8*b*. Therefore, the switching device 100 is effectively waterproofed.

While the switching device 100 according to the invention is used in the power window system in the respective embodiments described herein, the invention is applicable to other switching devices such as a switching device for door opening and closing system and a switching device used for applications other than vehicle equipment.

What is claimed is:

1. A switching device, comprising:

a switch;

a case within which the switch is accommodated;

a cylindrical hollow section which is disposed on the upper surface of the case and has upper and lower openings to communicate with the inside of the case;

an operation knob provided to cover the upper opening of the cylindrical section such that the operation knob can swing; and an operation bar penetrating through the lower opening of the cylindrical section and extending to the inside of the case so as to transmit the motion of the operation knob to the switch, wherein:

a projection for preventing water from entering into the case is provided on the outside surface of the cylindrical section opposed to the inside surface of the operation knob.

2. A switching device according to claim 1, wherein:

the operation knob is supported by the cylindrical section such that the operation knob can swing; and among the outside surface of the cylindrical section, the projection is provided on the outside surface of the cylindrical section on the side to and from which the inside surface of the operation knob shifts close and away in accordance with the swinging motion of the operation knob.

3. A switching device according to claim 2, wherein the projection is disposed at the upper end of the outside surface.

4. A switching device according to claim 2 or 3, wherein the projection is provided on both sides of the outside surface of the cylindrical section with the upper opening of the cylindrical section interposed between both sides of the outside surface.

5. A switching device, comprising:

a switch;

a case within which the switch is accommodated;

a cylindrical hollow section which is disposed on the upper surface of the case and has upper and lower openings to communicate with the inside of the case;

an operation knob provided to cover the upper opening of the cylindrical section such that the operation knob can swing; and an operation bar penetrating through the lower opening of the cylindrical section and extending to the inside of the case so as to transmit the motion of the operation knob to the switch, wherein:

a plurality of grooves for preventing water from entering into the case vertically extend on the outside surface of the cylindrical section opposed to the inside surface of the operation knob.

6. A switching device, comprising:

a switch;

a case within which the switch is accommodated;

a cylindrical hollow section which is disposed on the upper surface of the case and has upper and lower openings to communicate with the inside of the case;

an operation knob provided to cover the upper opening of the cylindrical section such that the operation knob can swing; and an operation bar penetrating through the lower opening of the cylindrical section and extending to the inside of the case so as to transmit the motion of the operation knob to the switch, wherein:

a projection for preventing water from entering into the case is provided on the inside surface of the operation knob opposed to the outside surface of the cylindrical section.

* * * * *